US006578988B2

(12) United States Patent
Johnson et al.

(10) Patent No.: US 6,578,988 B2
(45) Date of Patent: Jun. 17, 2003

(54) APPARATUS AND METHOD FOR DISSIPATING HEAT SENSITIVE COMPONENTS IN LIGHTING FIXTURES BY DISSIPATING HEAT THEREFROM

(75) Inventors: David M. Johnson, Hendersonville, NC (US); G. Frank Dye, Fletcher, NC (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/850,603

(22) Filed: May 7, 2001

(65) Prior Publication Data

US 2002/0163809 A1 Nov. 7, 2002

(51) Int. Cl.[7] ..... F21V 29/00
(52) U.S. Cl. ..... 362/294; 362/373; 362/264
(58) Field of Search ..... 362/373, 294, 362/264

(56) References Cited

U.S. PATENT DOCUMENTS

| | | | | |
|---|---|---|---|---|
| 4,019,044 A | | 4/1977 | Kelly et al. | 362/307 |
| 4,156,902 A | | 5/1979 | Wandler | 362/307 |
| 4,220,986 A | | 9/1980 | Matteo et al. | 362/362 |
| 4,374,407 A | | 2/1983 | Drost et al. | 362/432 |
| 4,414,615 A | * | 11/1983 | Szeker et al. | 362/263 |
| 4,414,616 A | | 11/1983 | de Vos et al. | 362/308 |
| 4,598,347 A | * | 7/1986 | Peppers | 362/294 |
| 4,729,076 A | * | 3/1988 | Masami et al. | 165/104.33 |
| 4,791,539 A | | 12/1988 | Ewing | 362/226 |
| 4,937,718 A | | 6/1990 | Murray | 362/431 |
| 5,136,490 A | * | 8/1992 | Morrison | 362/294 |
| 5,136,493 A | | 8/1992 | Straus et al. | 362/373 |
| 5,243,508 A | | 9/1993 | Ewing et al. | 362/431 |
| 5,351,174 A | | 9/1994 | Ewing | 362/226 |
| 5,528,474 A | * | 6/1996 | Roney et al. | 264/272.13 |
| 5,680,718 A | | 10/1997 | Ratcliffe et al. | 40/239 |
| 5,746,507 A | | 5/1998 | Lee | 362/365 |
| 5,785,418 A | * | 7/1998 | Hochstein | 362/294 |
| 5,941,632 A | | 8/1999 | Wedell et al. | 362/410 |
| 5,997,158 A | | 12/1999 | Fischer et al. | 362/324 |
| 6,200,007 B1 | * | 3/2001 | Minissi et al. | 362/285 |

* cited by examiner

*Primary Examiner*—Sandra O'Shea
*Assistant Examiner*—Ismael Negron
(74) *Attorney, Agent, or Firm*—Fay, Sharpe, Fagan, Minnich & McKee, LLP

(57) ABSTRACT

A lighting fixture including a housing having an exterior wall with interior and exterior surfaces, a tray contained in the housing, at least one heat-sensitive component contained in the housing, and a mount secured to the tray supporting the heat-sensitive component. The mount maintains the heat-sensitive component in thermal contact with the interior surface of the exterior wall of the housing, thereby facilitating dissipation of heat from the heat-sensitive component through the exterior wall of the housing.

28 Claims, 5 Drawing Sheets

APPARATUS AND METHOD FOR DISSIPATING HEAT SENSITIVE COMPONENTS IN LIGHTING FIXTURES BY DISSIPATING HEAT THEREFROM

BACKGROUND OF THE INVENTION

As high intensity discharge (HID) lighting fixtures are operated, electrical components housed therein are subjected to intense heat. Many such components are exposed to heat generated both by themselves and other components. This is true with regard to both the lamp itself and various electrical components located along the electrical path between the power source and the lamp.

In order to enhance fixture longevity and to avoid potential thermal damage of fixture components, the lighting fixture is traditionally designed and manufactured according to tolerances set with a view toward managing the thermal characteristics of the fixture components and the fixture interior in general. This is particularly true with regard to large HID industrial and commercial lighting fixtures used to illuminate streets, airports, stadiums, arenas, fields and other large light-critical spaces. One heat-sensitive fixture component that must be considered in the management of the thermal characteristics of the lighting fixture is the capacitor. In industrial and commercial lighting fixtures, capacitors are one of the larger electrical components, thereby occupying a substantial portion of the interior of the fixture and being exposed to substantial heat within the fixture. However, capacitors are quite heat-sensitive and have a relatively low maximum temperature rating. For instance, in a relevant industrial/commercial lighting fixture designed and manufactured by General Electric Company, the maximum operating temperature for the capacitor is set at 90 degrees Celsius, while the maximum operating temperature for the ballast of the same fixture are set at 165 to 180 degrees Celsius.

Traditionally, the capacitor is attached to and directly contacts the same support utilized by the ballast of the fixture. This arrangement results in significant heat transfer to the capacitor from the lamp and ballast, unacceptably low heat dissipation, and, ultimately, operation of the capacitor near or at its maximum operating temperature. One possible solution for maintaining the capacitor at a lower temperature during fixture operation is to enlarge the fixture to allow more airspace inside the fixture for greater heat dissipation. However, larger fixtures are more expensive to install, maintain, and replace than smaller fixtures, making fixture enlargement an economically inefficient solution.

SUMMARY OF THE INVENTION

Embodiments of the present invention address the concerns mentioned above through utilization of a resilient mount that maintains the capacitor itself in thermal contact with the interior wall of the fixture housing, thereby separating the capacitor from the other heat-generating electrical components in the fixture and maximizing capacitor heat dissipation through the fixture housing into ambient airspace.

In one aspect a lighting fixture is provided which includes a housing having an exterior wall with interior and exterior surfaces, a tray contained in the housing, at least one heat-sensitive component contained in the housing, and a mount secured to the tray supporting the heat-sensitive component, the mount maintaining the heat-sensitive component in thermal contact with the interior surface of the exterior wall of the housing, thereby facilitating dissipation of heat from the heat-sensitive component through the exterior wall of the housing.

In another aspect a method is provided for dissipating heat from a heat-sensitive component contained in a lighting fixture, said method including the steps of providing a lighting fixture comprising a housing having an exterior wall with interior and exterior surfaces, a tray contained in said housing, at least one heat-sensitive component contained in said housing, and a mount secured to said tray; attaching said heat-sensitive component to said mount; and orienting said tray in said housing such that said heat-sensitive component is maintained in thermal contact with said interior surface of said exterior wall of said housing.

DETAILED DESCRIPTION OF THE INVENTION

Figure 1:
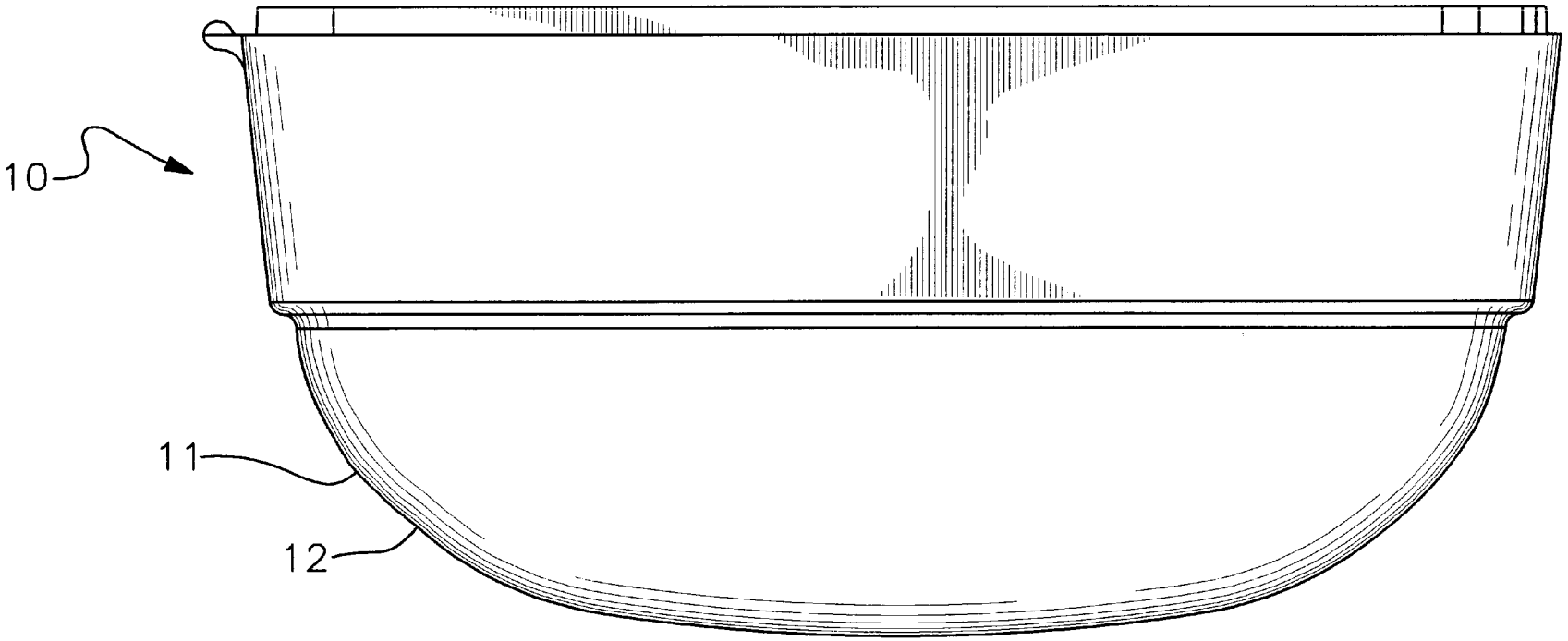
FIG. 1 is a side elevational view of a lighting fixture embodying the invention.

Referring now to the drawings, an HID lighting fixture embodying the invention is shown generally at reference numeral 10 in FIG. 1. The fixture 10 is generally of the type used in industrial and commercial applications to illuminate large open spaces such as streets, stadiums, arenas, fields, and airports. The fixture 10 includes a housing 11 having an exterior wall 12.

Figure 2:
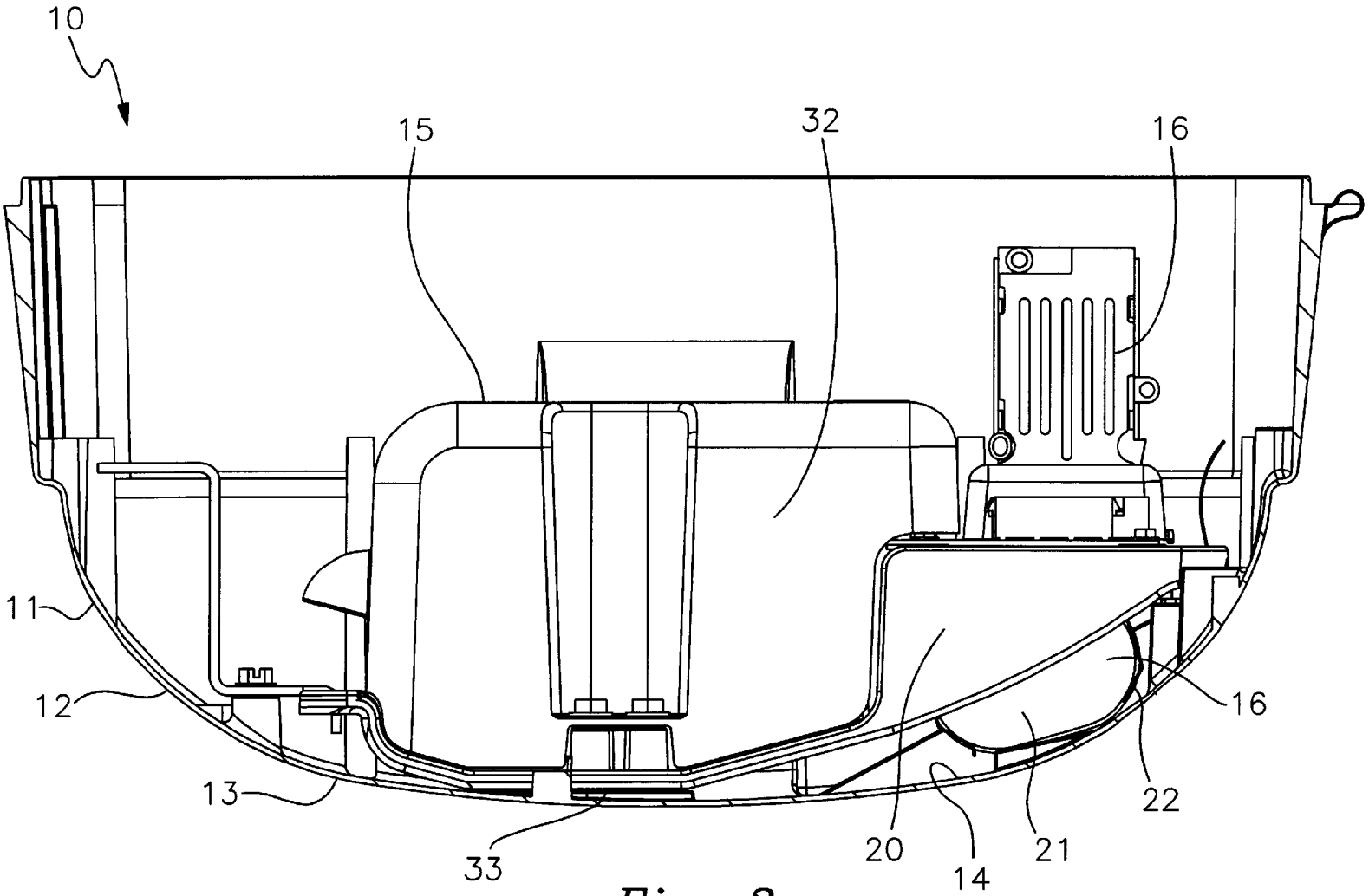
FIG. 2 is a cross-sectional view of the lighting fixture of FIG. 1.

Turning now to FIG. 2, the exterior wall 12 of the housing 11 is shown to have an exterior surface 13 and an interior surface 14. Contained within the housing 11 is a module 15 that carries or contains a plurality of electrical components 16 for operation of the fixture 10 (internal components not shown). Although other suitable modules may be employed, the module 15 is preferably as disclosed in commonly-assigned U.S. patent application Ser. No. 09/703,143, filed Oct. 31, 2000.

Figure 3:
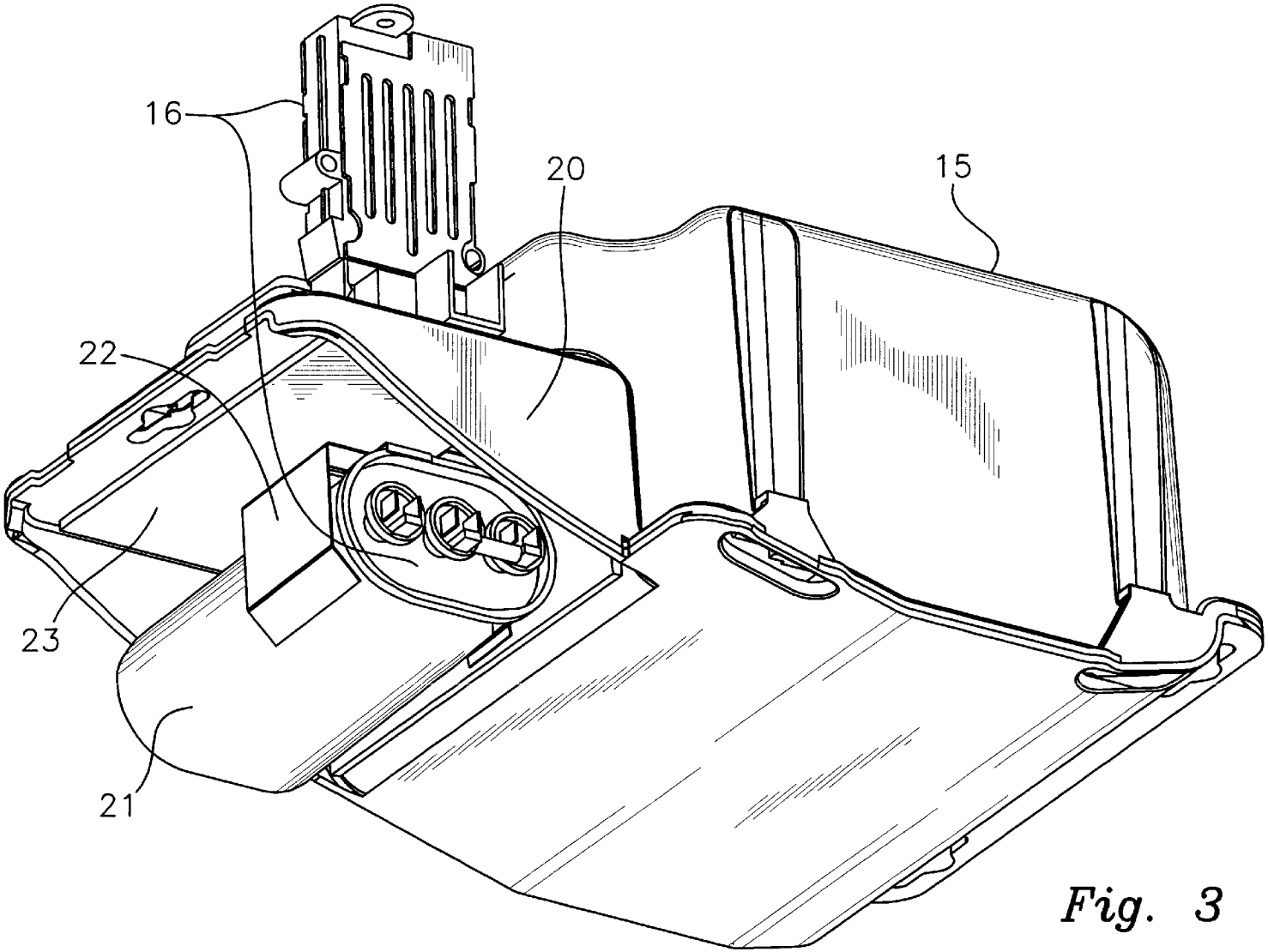
FIG. 3 is a perspective view of a component module removed from the lighting fixture shown in FIGS. 1 and 2, including a tray and a capacitor mounted on the tray.

FIG. 3 shows the module 15 after it has been removed from the housing 11. The module includes a tray 20 for supporting the plurality of electrical components 16 as well as any barriers necessary for electrical safety. Among the plurality of electrical components is a heat-sensitive component 21 such as a capacitor. In an embodiment of the invention, the heat-sensitive component 21 is mounted under the tray 20 using a mount 22 such as a spring clip or a flexible structure similar thereto, tie wrap, RTV silicone adhesive, or a strap tightened about the heat-sensitive component with a screw. As shown in FIG. 2, the mount 22 maintains the heat-sensitive component 21 in thermal contact with the interior surface 14 of the exterior wall 12 of the housing 11, thereby enhancing dissipation of heat from the heat-sensitive component 21 to the airspace outside the housing 11. However, the mount 22 must be carefully designed to achieve this goal without exerting damagingly high force on the heat-sensitive component 21 and exterior wall 12.

Turning again to FIG. 3, another goal of the mount 22 is to separate the heat-sensitive component 21 from the tray 20 such that heat transferred from the tray 20 and the module 15 to the heat-sensitive component 21 is minimized. Aiding the mount 22 in the achievement of this goal is a sheet of thermal insulation 23 situated between the heat-sensitive component 21 and the tray 20.

Figure 4:
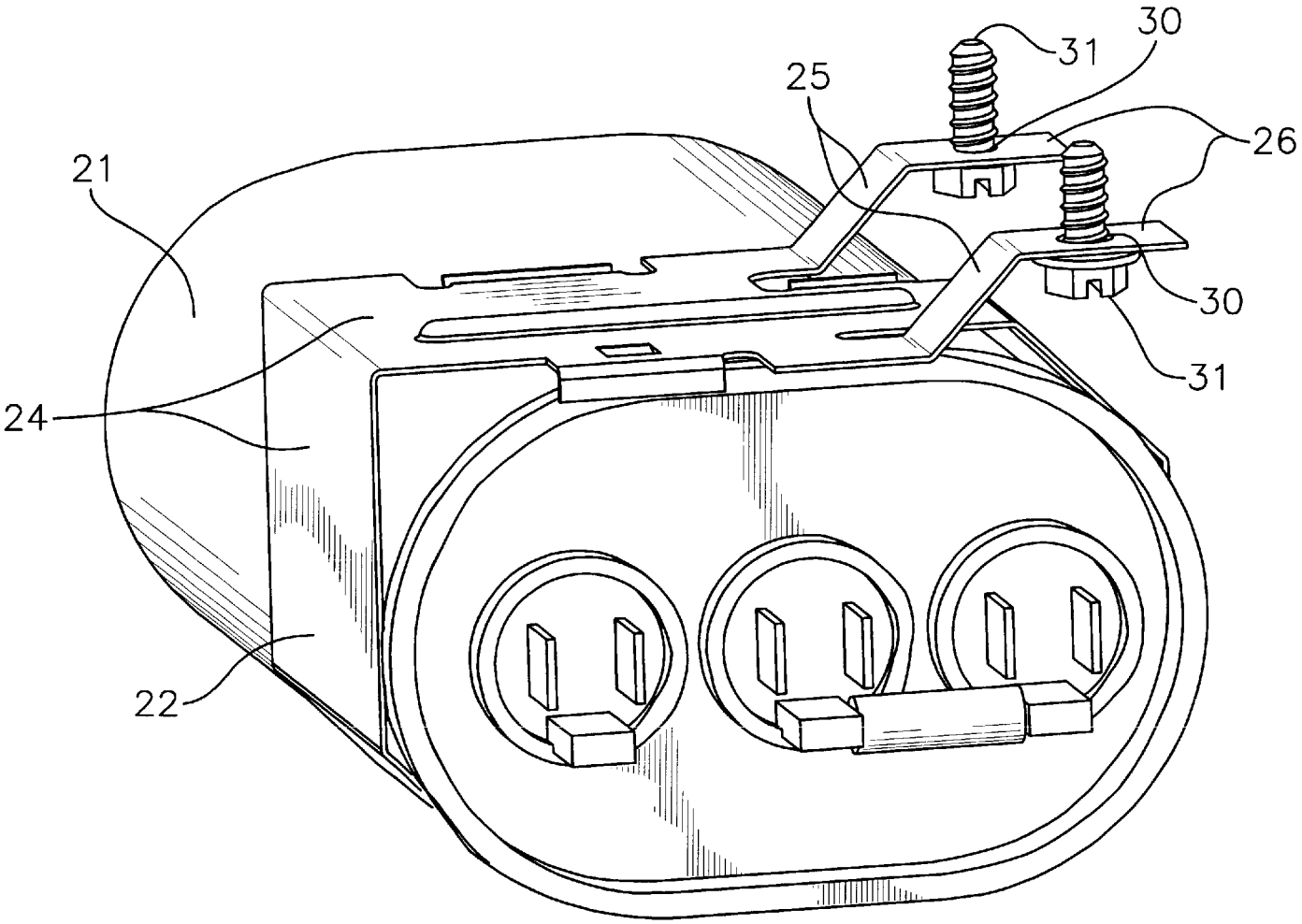
FIG. 4 is a perspective view of the capacitor and accompanying mount shown in FIG. 3.
Figure 5:
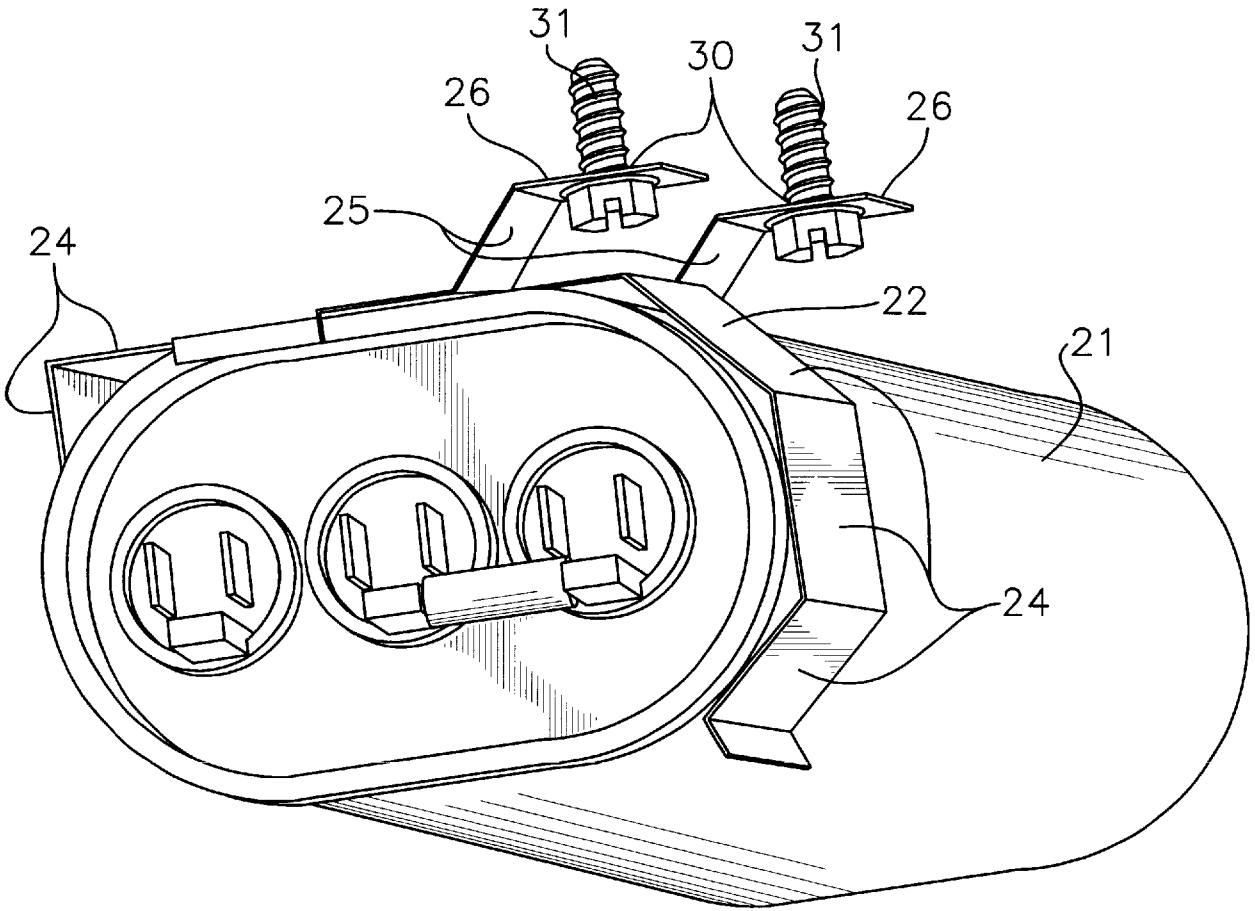
FIG. 5 is another perspective view of the capacitor and mount shown in FIG. 4.

Referring now to FIGS. 4 and 5, only the heat-sensitive component 21 and mount 22 are shown in order that the structure of the mount 22 may be described. The mount is formed of material that is a poor thermal conductor, such as stainless steel. This composition helps assure that, although the mount 22 is attached to the tray 20, the amount of heat transferred from the tray 20 and the module 15 along the mount 22 to the heat-sensitive component 21 is minimized. In addition, to reduce the infra-red absorption of the mount 22, it is left unpainted.

The mount 22 may be described as having two primary portions, a component-receiving portion and a fastener-receiving portion. The component-receiving portion is comprised of a plurality of panels 24 integrally formed with one another such that, when the mount 22 is in use, the panels 24 engage the exterior of the heat-sensitive component 21 in a manner that enables the mount 22 to hold the heat-sensitive component 21 stationary. The fastener-receiving portion includes at least one and preferably two prongs 25 integrally formed with and extending upward from one of the panels 24 of the component-receiving portion of the mount 22. Distal ends 26 of the prongs 25 are each provided with an opening 30 for receiving a fastener 31 such as a threaded screw, a nail, a brad, or a bolt. To secure the mount 22 to the tray 20, the fasteners 31 are inserted in corresponding, complementary openings in the tray (not shown) and adjusted until the mount 22 is suitably attached to the tray 20.

To further enhance heat dissipation from within the housing 11, as shown in FIG. 2, the tray 20 also supports a ballast 32 of the fixture 10 such that a ballast-supporting portion 33 of the tray 20 is in thermal contact with the interior surface 14 of the exterior wall 12 of the housing 11, thereby allowing heat dissipation from the ballast 32 through the exterior wall 12 of the housing 11 into airspace outside the fixture 10.

An apparatus and method for dissipating heat from heat-sensitive components in lighting fixtures is described above. Various details of the invention may be changed without departing from its scope. Furthermore, the foregoing description of the invention and the best mode for practicing the invention are provided for the purpose of illustration only and not for the purpose of limitation-the invention being defined by the claims.

What is claimed is:

1. A lighting fixture comprising:

a housing having an exterior wall with interior and exterior surfaces;

a tray contained in said housing;

at least one heat-sensitive component contained in said housing; and a mount secured to said tray supporting said heat-sensitive component, said mount maintaining said heat-sensitive component in thermal contact with said interior surface of said exterior wall of said housing, thereby facilitating dissipation of heat from said heat-sensitive component through said exterior wall of said housing;

said thermal contact of said heat-sensitive component with said interior surface of said exterior wall is due to direct abutting engagement of a portion of said heat-sensitive component with a portion of said inside surface of said exterior wall.

2. A lighting fixture according to claim 1, wherein said mount maintains said heat-sensitive component in spaced-apart relation to said tray.

3. A lighting fixture according to claim 1, wherein said heat-sensitive component comprises a capacitor.

4. A lighting fixture according to claim 1, wherein said mount is capable of being repeatedly attached to and detached from said tray.

5. A lighting fixture according to claim 1, wherein said mount is flexible.

6. A lighting fixture according to claim 1, further comprising thermal insulation between said tray and said heat-sensitive component.

7. A lighting fixture according to claim 1, further comprising a ballast supported by said tray such that a portion of said tray supporting said ballast is maintained in contact with said interior surface of said exterior wall of said housing, thereby facilitating dissipation of heat from said ballast through said exterior wall of said housing.

8. A lighting fixture according to claim 1, wherein said mount comprises a material which is a poor thermal conductor.

9. A lighting fixture according to claim 8, wherein said material comprises stainless steel.

10. A lighting fixture according to claim 1, wherein said mount comprises a fastener-receiving portion secured to said tray and a portion for receiving said heat-sensitive component.

11. A lighting fixture according to claim 10, wherein said component-receiving portion of said mount comprises a spring clip integrally formed with said fastener-receiving portion of said mount.

12. A lighting fixture according to claim 10, wherein said heat-sensitive component is attached to said component-receiving portion of said mount with tie wrap.

13. A lighting fixture according to claim 10, wherein said heat-sensitive component is attached to said component-receiving portion of said mount using RTV silicone adhesive.

14. A lighting fixture according to claim 10, wherein said heat-sensitive component is attached to said component-receiving portion of said mount with a strap tightened about said heat-sensitive component with a screw.

15. A method for dissipating heat from a heat-sensitive component contained in a lighting fixture, said method comprising the steps of:

providing a lighting fixture comprising a housing having an exterior wail with interior and exterior surfaces, a tray contained in said housing, at least one heat-sensitive component contained in said housing, and a mount secured to said tray;

attaching said heat-sensitive component to said mount; and orienting said tray in said housing such that said heat-sensitive component is maintained in thermal contact with said interior surface of said exterior wall of said housing;

said step of orienting said tray in said housing including placing a portion of said heat-sensitive component in direct physical contact with a portion of said inside surface of said exterior wall.

16. A method according to claim 15, wherein said mount maintains said heat-sensitive component in spaced-apart relation to said tray.

17. A method according to claim 15, wherein said heat-sensitive component is a capacitor.

18. A method according to claim 15, wherein said mount is capable of being repeatedly attached to and detached from said tray.

19. A method according to claim 15, wherein said mount is flexible.

20. A method according to claim 15, wherein said lighting fixture further comprises thermal insulation between said tray and said heat-sensitive component.

21. A method according to claim 15, wherein said lighting fixture further comprises a ballast supported by said tray such that a portion of said tray supporting said ballast is maintained in contact with said interior surface of said exterior wall of said housing, thereby facilitating dissipation of heat from said ballast through said exterior wall of said housing.

22. A method according to claim 15, wherein said mount comprises a material which is a poor thermal conductor.

23. A method according to claim 22, wherein said material comprises stainless steel.

24. A method according to claim 15, wherein said mount comprises a fastener-receiving portion secured to said tray and a portion for receiving said heat-sensitive component.

25. A method according to claim 24, wherein said component-receiving portion of said mount comprises a spring clip integrally formed with said fastener-receiving portion of said mount.

26. A method according to claim 24, wherein said heat-sensitive component is attached to said component-receiving portion of said mount with tie wrap.

27. A method according to claim 24, wherein said heat-sensitive component is attached to said component-receiving portion of said mount using RTV silicone adhesive.

28. A method according to claim 24, wherein said heat-sensitive component is attached to said component-receiving portion of said mount with a strap tightened about said heat-sensitive component with a screw.

* * * * *